US011953001B2

(12) United States Patent
Park et al.

(10) Patent No.: US 11,953,001 B2
(45) Date of Patent: Apr. 9, 2024

(54) HORIZONTAL TYPE ROTARY COMPRESSOR AND HOME APPLIANCE INCLUDING THE SAME

(71) Applicant: SAMSUNG ELECTRONICS CO., LTD., Suwon-si (KR)

(72) Inventors: Soodol Park, Suwon-si (KR); Joonhyung Kim, Suwon-si (KR); Munseong Kwon, Suwon-si (KR); Jaewoo Park, Suwon-si (KR); Hyolim Heo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 17 days.

(21) Appl. No.: 17/747,991

(22) Filed: May 18, 2022

(65) Prior Publication Data

US 2023/0021042 A1 Jan. 19, 2023

Related U.S. Application Data

(63) Continuation of application No. PCT/KR2021/018108, filed on Dec. 2, 2021.

(30) Foreign Application Priority Data

Jul. 15, 2021 (KR) ..... 10-2021-0092869

(51) Int. Cl.
*F04C 15/00* (2006.01)
*F04C 2/12* (2006.01)
(Continued)

(52) U.S. Cl.
CPC ..... *F04C 15/0088* (2013.01); *F04C 2/12* (2013.01); *F04C 29/02* (2013.01); *F04C 29/026* (2013.01); *F04C 2240/30* (2013.01)

(58) Field of Classification Search
CPC ..... F04C 15/0088; F04C 2/12; F04C 29/02; F04C 29/12; F04C 29/026; F04C 29/045; F04C 23/001; F04C 23/008
See application file for complete search history.

(56) References Cited

U.S. PATENT DOCUMENTS 6,893,237 B2 5/2005 Yamanaka et al.
7,040,880 B2 5/2006 Hasegawa et al.
(Continued)

FOREIGN PATENT DOCUMENTS

JP H07217576 A * 2/1994 ..... F04C 29/02
JP 2003-269356 9/2003
(Continued)

OTHER PUBLICATIONS

English copy of JH 07217576 by PE2E Jul. 26, 23.*
(Continued)

*Primary Examiner* — Deming Wan
(74) *Attorney, Agent, or Firm* — STAAS & HALSEY LLP

(57) ABSTRACT

A horizontal type rotary compressor includes a case including an inlet and an outlet and configured to store oil, a compressor having a compression space in which refrigerant is accommodated, a driver to drive the compressor, a rotating shaft to connect the driver and the compressor, an oil feed pipe disposed at a side of the compressor, a first plate configured to divide the case into a first area for the driver and a second area for the compressor. The first plate including a discharge hole through which compressed refrigerant is discharged from the compressor to the first area. A second plate dividing the case into the second area and a third area in which the oil feed pipe communicates with the outlet, and
(Continued)

includes a second hole formed at the upper side to communicate the second and third areas. The first and second plates forming an oil flow path.

15 Claims, 8 Drawing Sheets

(51) Int. Cl.

| | |
|---|---|
| ***F04C 18/00*** | (2006.01) |
| ***F04C 23/00*** | (2006.01) |
| ***F04C 29/02*** | (2006.01) |
| ***F04C 29/12*** | (2006.01) |

(56) References Cited

U.S. PATENT DOCUMENTS

| | | | | |
|---|---|---|---|---|
| 2002/0110463 | A1* | 8/2002 | Matsumoto | F04C 23/008 417/366 |
| 2020/0362863 | A1 | 11/2020 | Liang et al. | |
| 2023/0094593 | A1* | 3/2023 | Cho | F04C 18/356 417/410.3 |

FOREIGN PATENT DOCUMENTS

| | | | | |
|---|---|---|---|---|
| JP | 2003269356 | A * | 9/2003 | F04C 23/001 |
| JP | 2004-324507 | | 11/2004 | |
| JP | 2017-137761 | | 8/2017 | |
| KR | 10-1995-0019226 | | 7/1995 | |
| KR | 10-1995-0023855 | | 8/1995 | |
| KR | 20-0139334 | | 5/1999 | |
| KR | 2003-0076306 | | 9/2003 | |
| KR | 10-2004-0092381 | | 11/2004 | |
| KR | 10-2005-0011231 | | 1/2005 | |
| KR | 10-2005-0021572 | | 3/2005 | |
| KR | 10-0492955 | | 8/2005 | |
| KR | 10-0629870 | | 9/2006 | |
| KR | 10-1045672 | | 6/2011 | |

OTHER PUBLICATIONS

English translation of JP 2003269356 by PE2E Dec. 13, 23.*
International Search Report dated Apr. 14, 2022 from International Application No. PCT/KR2021/018108.
Written Opinion of the International Searching Authority dated Apr. 14, 2022 from International Application No. PCT/KR2021/018108.

* cited by examiner

HORIZONTAL TYPE ROTARY COMPRESSOR AND HOME APPLIANCE INCLUDING THE SAME

CROSS-REFERENCE TO RELATED APPLICATION(S)

This application is a continuation application, under 35 U.S.C. § 111(a), of International Patent Application PCT/KR2021/018108 filed on Dec. 2, 2021, and claims priority under 35 U.S.C. § 119 to Korean Patent Application No. 10-2021-0092869, filed on Jul. 15, 2021 in the Korean Intellectual Property Office, the disclosures of which are incorporated by reference herein in their entirety.

BACKGROUND

1. Field

The disclosure relates to a horizontal type rotary compressor with an improved structure allowing for fueling to be stable without tilting a compressor and a home appliance including the same.

2. Description of Related Art

A compressor is a mechanical device configured to use a motor or a turbine to increase pressure by compressing air, a refrigerant, or other various working gas. The compressor may be variously used throughout the industry, and when used in a refrigerant cycle, the compressor may be configured to convert a low-pressure refrigerant to a high pressure refrigerant and transfer the refrigerant back to a condenser.

The compressor may be largely divided into a reciprocating-type compressor configured so that a compression space at which working gas is suctioned and discharged is formed between a piston and a cylinder, and compresses the refrigerant while the piston performs a rectilinear reciprocating motion inside the cylinder, a scroll compressor configured so that a compression space at which working gas is suctioned and discharged is formed between an orbiting scroll and a fixed scroll, and compresses the refrigerant while the orbiting scroll rotates along the fixed scroll, and a rotary-type compressor configured so that a compression space at which working gas is suctioned and discharged is formed between a rolling piston which is eccentrically rotated and the cylinder, and compresses the refrigerant while the rolling piston is eccentrically rotated along an inner wall of the cylinder.

However, a horizontal type rotary compressor of the related art includes disadvantages such as workability being decreased because the compressor required tilting and a height of the compressor increasing in order to provide oil which functions as lubrication to various components.

SUMMARY

According to an embodiment, a horizontal type rotary compressor includes a case including an inlet and an outlet, and configured to store oil, a compression device configured with a compression space in which refrigerant introduced from the inlet is accommodated, a driving device disposed at one side of the compression device and configured to drive the compression device, a rotating shaft configured to connect the driving device and the compression device, and penetrate the compression device, an oil feed pipe disposed at the other side of the compression device, where one end is connected with the rotating shaft and other end is disposed adjacent with a lower surface of the case such that the other end is submerged in oil, a first plate configured to divide an inside of the case into a first area in which the driving device is disposed and a second area in which the compression device is disposed, and include a discharge hole through which a compressed refrigerant is discharged from the compression device to the first area and a first hole formed at an upper side to communicate the first and second areas, and a second plate configured to divide the inside of the case into the second area and a third area in which the oil feed pipe is disposed and which communicates with the outlet, and include a second hole formed at the upper side to communicate the second and third areas, and the first and second plates have lower ends spaced apart from the lower surface of the case to form an oil flow path.

The rotating shaft may include an oil flow path space configured to communicate with the oil feed pipe and be formed in a lengthwise direction inside of the rotating shaft and an oil feed hole configured to communicate the oil flow path space and an outside of the rotating shaft.

A diameter of the second hole may be between 0.04 fold or more and 0.1 fold or less of an inner diameter of the case.

Oil accommodated in the case may be stored at a first height based on the driving device not operating, and the lower ends of the first and second plates may be configured to be spaced apart from the lower surface of the case by a second height which is shorter than the first height.

The other end of the oil feed pipe may be configured to be spaced apart from the lower surface of the case by a third height, and the second height may be longer than the third height, and shorter than a radius of the case.

The horizontal type rotary compressor may further include a discharge pipe configured to penetrate the outlet and have one end disposed in the third area, a space disposed lower than the first height and disposed higher than the second height from among the first and second areas may have a first volume, a space disposed higher than the first height and disposed lower than one end of the outlet from among the third area may have a second volume, and the second volume may be greater than the first volume.

The horizontal type rotary compressor may further include a discharge pipe configured to penetrate the outlet and have one end disposed in the third area and formed to be bent to an upper side.

The driving device may include a rotor configured to be disposed surrounding the rotating shaft and rotatable with the rotating shaft and a stator configured to be fixed at an inner surface of the case and support the rotor to be rotatable.

The second plate may have a side surface contacting with an inner surface of the case.

The inlet is configured to communicate an outside of the case and the second area.

The compression device may include a flange member which has one surface facing the first area is covered by the first plate, and which includes a third hole communicating the compression space and the first area.

The flange member has a side surface contacting with an inner surface of the case, and includes a fourth hole formed lower than the lower end of the first plate.

The compression device may include a first cylinder and a second cylinder which respectively include a rolling piston configured to perform an orbiting motion with eccentricity in the compression space and a vane configured to be in contact with the rolling piston and divide the compression space into a suction chamber and a compression chamber, and a middle plate configured to be disposed between the first and second cylinders, and include a fifth hole communicating the compression chamber of the first cylinder and the compression chamber of the second cylinder, and the third hole may be configured to communicate the compression chamber of the first cylinder and the first area.

A cross-section area between the lower end of the second plate and the lower surface of the case may be between 0.05 fold or more and 0.35 fold or less of a cross-section area of the case.

According to an embodiment, a home appliance configured to adjust temperature through heat exchange with an outside using a refrigerant includes a horizontal type rotary compressor configured to compress the refrigerant, and the horizontal type rotary compressor includes a case including a suction point and an outlet, and configured to store oil, a compression device configured to compress refrigerant introduced from the inlet, a driving device disposed at one side of the compression device and configured to drive the compression device, a first plate configured to divide an inside of the case into a first area in which the driving device is disposed and a second area in which the compression device is disposed, and include a discharge hole through which a compressed refrigerant is discharged from the compression device to the first area and a first hole formed at an upper side to communicate the first and second areas, and a second plate configured to divide the inside of the case into the second area and a third area which communicates with the outlet, and include a second hole formed at the upper side to communicate the second and third areas, and the first and second plates have lower ends spaced apart from the lower surface of the case to form an oil flow path.

DETAILED DESCRIPTION

Aspects of the disclosure are to address at least the above-mentioned problems and/or disadvantages and to provide at least the advantages described below. Accordingly, an aspect of the disclosure is to provide a horizontal type rotary compressor with an improved structure allowing for fueling to be stable without tilting a compressor and a home appliance including the same.

Example embodiments described herein have been provided as an example to assist in the understanding of the disclosure, and unlike the example embodiments described herein, it should be understood that various changes and modifications may be made to the disclosure. However, in describing the embodiments, in case it is determined that detailed description of related known technologies may unnecessarily confuse the gist of the disclosure, the detailed description will be omitted. Further, the accompanied drawings may be illustrated so that sizes of some elements are exaggerated rather than illustrated to its actual scale for convenience of description.

Terms used in describing the various example embodiments of the disclosure are general terms selected considering their function herein. However, the terms may change depending on intention, legal or technical interpretation, emergence of new technologies, and the like of those skilled in the related art. Further, in certain cases, there may be terms arbitrarily selected. In this case, the meaning of the term may be interpreted to the meaning defined herein, and if there is no specific meaning of the term defined, it may be interpreted based on the overall context of the disclosure and the technical common sense according to the related art.

In the disclosure, expressions such as "comprise," "may comprise," "include," "may include," or the like are used to designate a presence of a corresponding characteristic (e.g., elements such as numerical value, function, operation, or component, etc.), and not to preclude a presence or a possibility of additional characteristics.

Further, because the elements necessary in describing the respective example embodiments of the disclosure are described, the disclosure is not necessarily limited hereto. Accordingly, some elements may be changed or omitted, and other elements may be added. In addition, the elements may be distributed and disposed in devices independent from one another.

Furthermore, although the example embodiments of the disclosure have been described in detail with reference to the accompanying drawings and the descriptions disclosed in the accompanying drawings, the disclosure is not limited by or limited to the example embodiments.

The disclosure will be described in greater detail below with reference to the accompanied drawings.

Figure 1:
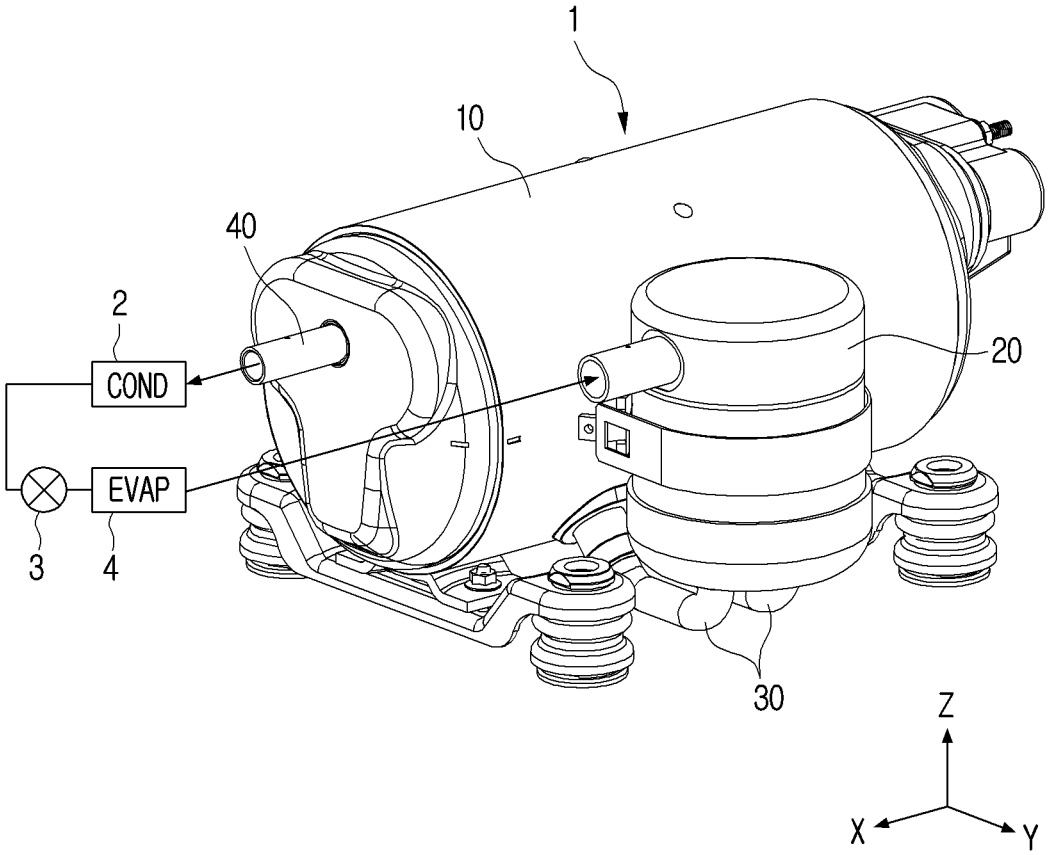
FIG. 1 is a perspective view illustrating a horizontal type rotary compressor according to an embodiment.

FIG. 1 is a perspective view illustrating a horizontal type rotary compressor according to an embodiment.

As illustrated in FIG. 1, a refrigeration cycle may include four types of strokes of compression, condensation, expansion, and evaporation, and the four types of strokes of compression, condensation, expansion, and evaporation may be generated as a refrigerant circulates a rotary compressor 1, a condenser 2, an expansion valve 3, and an evaporator 4.

A horizontal type rotary compressor 1 may be configured to compress refrigerant gas in a high temperature and high pressure state and discharge through a discharge pipe 40, and the high temperature and high pressure refrigerant gas discharged from the rotary compressor 1 may be introduced to the condenser 2.

In the condenser 2, the refrigerant compressed in the horizontal type rotary compressor 1 may be condensed into liquid, and heat may be dissipated to the surroundings through a condensation process.

The expansion valve 3 may be configured to expand the high temperature and high pressure state refrigerant which is condensed in the condenser 2 at a low pressure state, and the evaporator 4 may be configured to achieve a refrigeration effect by way of heat exchange with a material to be cooled by using latent heat from evaporation while evaporating the refrigerant which is expanded in the expansion valve 3.

Thereafter, the refrigerant gas in the low temperature and low pressure state may be returned to the horizontal type rotary compressor 1 through an accumulator 20 and a feed pipe 30. The accumulator 20 may be disposed between the evaporator 4 and the feed pipe 30. The accumulator 20 may be configured to store a liquid refrigerant so that the liquid refrigerant which is generated by a change in load according to the suction of the refrigerant is not introduced inside of the horizontal type rotary compressor 1.

A home appliance which includes the above-described refrigeration cycle may be one from among an air conditioner, a refrigerator or a freezer. However, the example embodiment is not limited thereto, and may be used in various home appliances which include the refrigeration cycle. The rotary compressor 1 according to an example embodiment of the disclosure may not only be used in the above-described home appliance, but also in various devices including the compressor.

Figure 2:
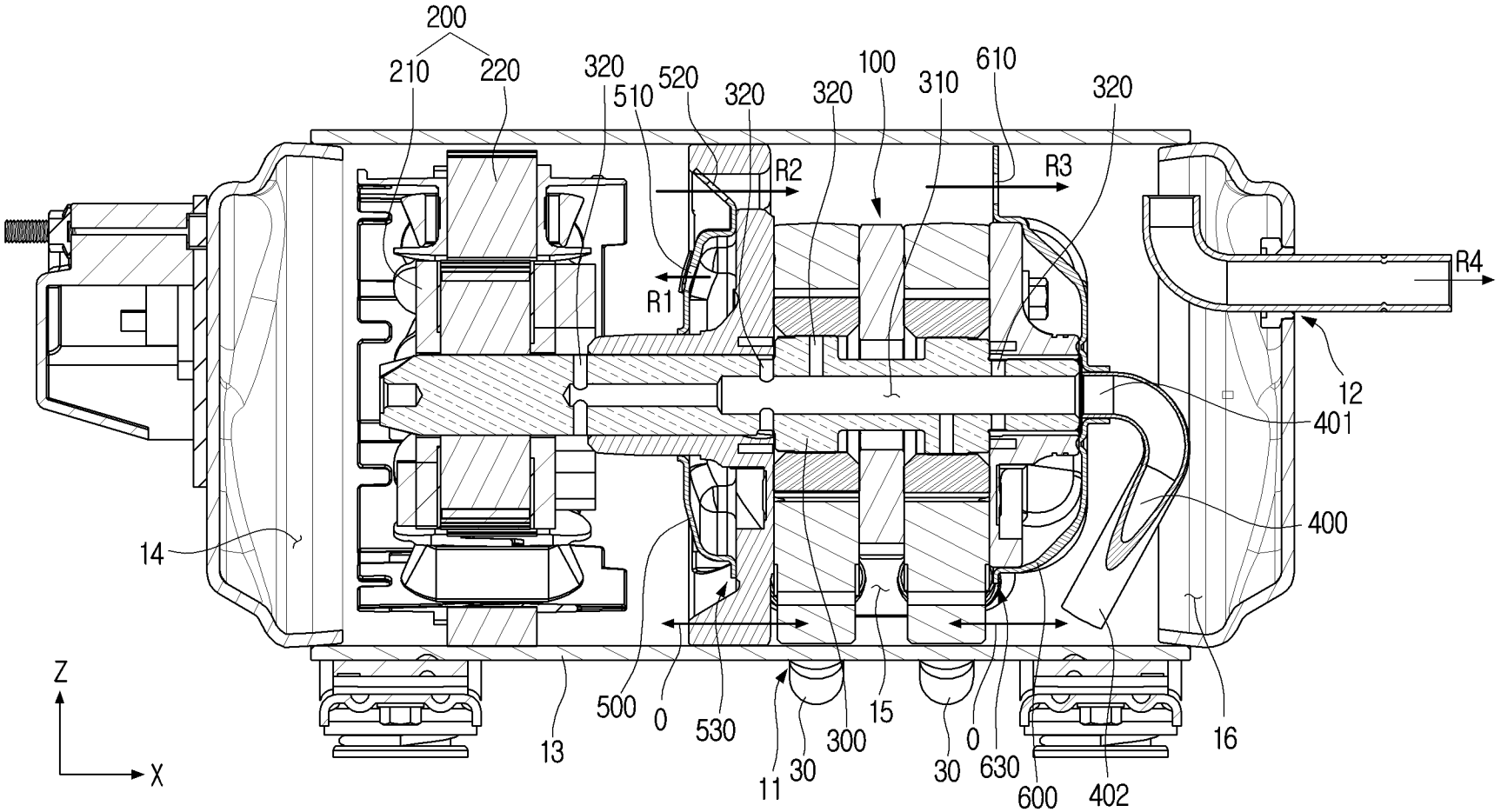
FIG. 2 is a cross-sectional view illustrating the horizontal type rotary compressor of FIG. 1.
Figure 3:
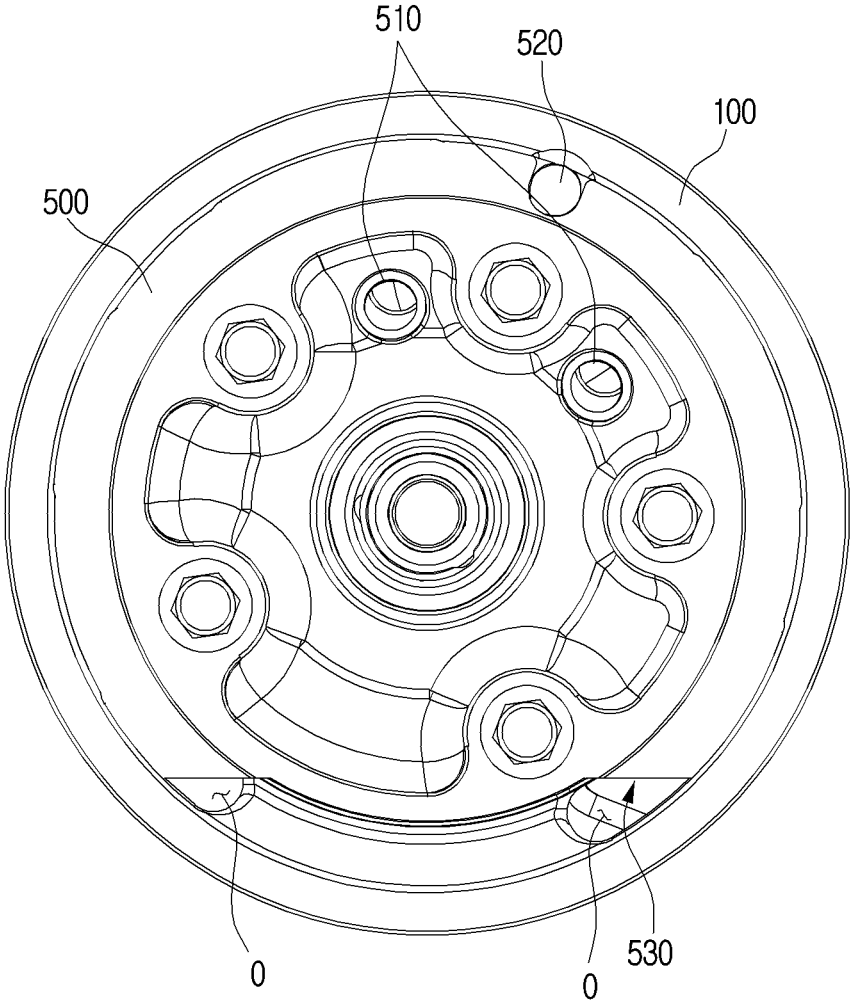
FIG. 3 and FIG. 4 are front views illustrating a first plate and a second plate of FIG. 1, respectively.
Figure 4:
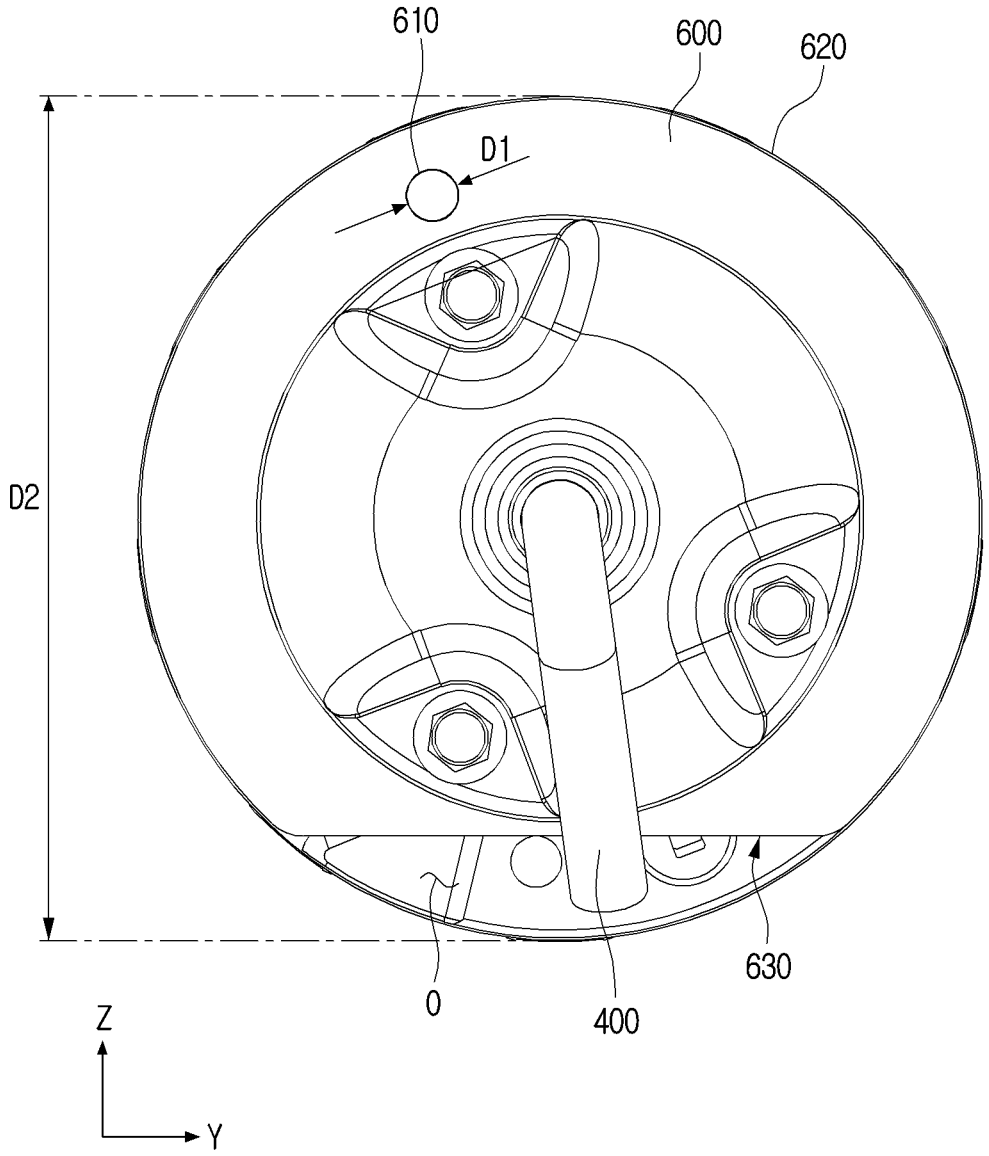

FIG. 2 is a cross-sectional view illustrating the horizontal type rotary compressor of FIG. 1. FIG. 3 and FIG. 4 are front views illustrating a first plate and a second plate of FIG. 1, respectively.

Referring to FIG. 2 to FIG. 4, the horizontal type rotary compressor 1 according to an example embodiment of the disclosure may include a case 10, a compression device 100, a driving device 200, a rotating shaft 300, an oil feed pipe 400, a first plate 500, and a second plate 600.

The case 10 may include an inlet 11 and an outlet 12, and oil may be stored.

The compression device 100 may include a compression space in which refrigerant introduced through the inlet 11 of the case 10 is accommodated. The compression device 100 may also be referred to as the compressor 100.

The driving device 200 may be disposed at one side of the compression device 100 and drive the compression device 100. The driving device 200 may also be referred to as the driver 200.

The driving device 200 may include a rotor 210 configured to be disposed surrounding the rotating shaft 300 and rotatable with the rotating shaft 300 and a stator 220 configured to be fixed at an inner surface of the case 10 and support the rotor 210 to be rotatable.

The rotating shaft 300 may be configured to connect the driving device 200 with the compression device 100, and penetrate the compression device 100.

The oil feed pipe 400 may be disposed at the other side of the compression device 100, where one end 401 is connected with the rotating shaft 300, and other end 402 is disposed adjacent with a lower surface 13 of the case 10 so as to be submerged in oil.

The first plate 500 may divide the inside of the case 10 into a first area 14 in which the driving device 200 is disposed and a second area 15 in which the compression device 100 is disposed.

The first plate 500 may include discharge holes 510 through which the compressed refrigerant is discharged from the compression device 100 to the first area 14. The first plate 500 may include a first hole 520 which is formed at a top side to communicate the first and second areas 14 and 15.

The first plate 500 may have a lower end 530 forming an oil flow path by being spaced apart from the lower surface 13 of the case 10. Specifically, the oil may flow between a lower end 530 of the first plate 500 and a lower surface 13 of the case 10, from the first area 14 to the second area 15, or from the second area 15 to the first area 14 along an oil flow path O.

The second plate 600 may divide the inside of the case 10 into the second area 15 and a third area 16 in which the oil feed pipe 400 is disposed and which communicates with the outlet 12.

The second plate 600 may has a side surface 620 contacting with the inner surface of the case 10. Accordingly, the refrigerant or oil may be prevented from flowing unintentionally between the side surface 620 of the second plate 600 and the inner surface of the case 10.

The second plate 600 may include a second hole 610 which is formed at the top side to communicate the second and third areas 15 and 16.

The second plate 600 may have a lower end 630 spaced apart from the lower surface 13 of the case to form an oil flow path. Specifically, the oil may flow between the lower end 630 of the second plate 600 and the lower surface 13 of the case 10, from the second area 15 to the third area 16, or from the third area 16 to the second area 15 along the oil flow path O.

The inlet 11 of the case 10 may be configured to communicate the outside of the case 10 and the second area 15. The feed pipe 30 may penetrate the inlet 11 of the case 10, and may be connected to the compression device 100 disposed in the second area 15. Accordingly, the low temperature and low pressure refrigerant discharged from the evaporator 4 may flow to the compression device 100 along the feed pipe 30.

Then, the low temperature and low pressure refrigerant may become the high temperature and high pressure refrigerant in the compression space of the compression device 100. The refrigerant discharged from the compression device 100 toward the first area 14 may penetrate the discharge holes 510 of the first plate 500 along a first refrigerant flow path R1 and flow to the first area 14. Accordingly, the pressure in the first area 14 may rise.

The high temperature and high pressure refrigerant located in the first area 14 may flow to the second area 15 through the first hole 520 of the first plate 500. That is, the refrigerant in the first area 14 may flow to the second area 15 along a second refrigerant flow path R2 which passes through the first hole 520. At this time, because a flow path cross-section area formed by the first hole 520 is smaller than a cross-section area of the flow path in the first area 14, the pressure of the refrigerant flowing from the first area 14 to the second area 15 may be reduced.

Likewise, the refrigerant located in the second area 15 may flow to the third area 16 through the second hole 610 of the second plate 600. That is the refrigerant of the second area 15 may flow to the third area 16 along a third refrigerant flow path R3 which passes through the second hole 610. The refrigerant located in the third area 16 may flow to the outside of the case 10 along a fourth refrigerant flow path R4 which is formed by the discharge pipe 40.

At this time, because the flow path cross-section area formed by the second hole 610 is smaller than the cross-section area of the flow path in the second area 15, the pressure of the refrigerant flowing from the second area 15 to the third area 16 may be reduced.

That is, the case 10 may be divided into the first to third areas 14, 15 and 16 by the first and second plates 500 and 600, and the first to third areas 14, 15 and 16 may have different pressures from one another. Specifically, the pressure of the first area 14 may be the highest, and the pressure of the third area 16 may be the lowest.

Accordingly, the oil stored in the case 10 may flow from the first area 14 to the second area 15, and from the second area 15 to the third area 16 due to the difference in pressure in the first to third areas 14, 15 and 16. That is, the oil may have the highest oil-level in the third area 16, and have the lowest oil level in the first area 14.

Because the oil stored in the third area 16 has a higher oil-level than the oil stored in the first and second areas 14 and 15, the oil may easily flow inside of the oil feed pipe 400 without tilting the horizontal type rotary compressor 1.

In addition, because a sufficiently high oil-level is formed in the third area 16, even if a small amount of oil is refilled in the case 10, the oil stored in the third area 16 may easily flow to the inside of the oil feed pipe 400.

Because the oil stored in the first area 14 has a sufficiently low oil-level, the oil may not be in contact with the rotor 210 of the driving device 200 as much as possible. Accordingly, noise and oil foaming generated when the rotor 210 and the oil collide may be reduced.

In addition, because the oil stored in the second area 15 has a sufficiently high oil-level, a plurality of components in the compression device 100 may be submerged in oil. Accordingly, the oil may prevent leakage of the refrigerant which may be leaked from gaps in between the plurality of components in the compression device 100.

The rotating shaft 300 may include an oil flow path space 310 configured to communicate with the oil feed pipe 400, and be formed in a lengthwise direction inside of the rotating shaft 300. In addition, the rotating shaft 300 may include an oil feed hole 320 configured to communicate the oil flow path space 310 and the outside of the rotating shaft 300. The oil feed hole 320 may be formed in plurality along the lengthwise direction of the rotating shaft 300.

Accordingly, the oil stored in the third area 16 may be configured to sequentially pass the oil feed pipe 400, the oil flow path space 310, and the oil feed hole 320, and function as a lubricant between the compression device 100 and the rotating shaft 300.

According to Bernoulli's law, the height difference in oil-level of the oil stored in the first and second areas 14 and 15 may be inversely proportional to the square of the cross-section area of the first hole 520. In addition, the height difference in oil-level of the oil stored in the second and third areas 15 and 16 may be inversely proportional to the square of the cross-section area of the second hole 610.

That is, the smaller the cross-section area of the first hole 520 becomes, the oil-level of the second area 15 may become higher than the oil-level of the first area 14, and the smaller the cross-section area of the second hole 610 becomes, the oil-level of the third area 16 may become higher than the oil-level of the second area 15.

A diameter D1 of the second hole 610 on the second plate 600 may be 0.04 folds or more of a diameter D2 of the case 10. Accordingly, the oil may be prevented from leaking to the outside of the case 10 unintentionally through the discharge pipe 40 due to the oil-level of the third area 16 excessively rising.

In addition, the diameter D1 of the second hole 610 on the second plate 600 may be 0.1 fold or less of the diameter D2 of the case. Accordingly, because a sufficiently large oil-level difference is formed between the second and third areas 15 and 16, the oil stored in the third area 16 may easily flow inside of the oil feed pipe 400 without having to tilt the horizontal type rotary compressor 1.

In addition, the cross-section area between the lower end 630 of the second plate 600 and the lower surface 13 of the case 10 may be between 0.05 folds or more and 0.35 folds or less of the cross-section area of the case 10. Here, the cross-section area may be the area when a configuration is cut in parallel with a YZ plane. That is, the cross-section area may be a vertical cross-section area which is formed by cutting the configuration along a vertical direction. The cross-section area of the case 10 may be the cross-section area formed by the diameter D2 of the case 10.

Accordingly, because the oil flow path between the lower end 630 of the second plate 600 and the lower surface 13 of the case 10 is sufficiently and largely secured, a phenomenon of oil unintentionally leaking to the outside through the discharge pipe 40 due to the oil-level of the third area 16 very rapidly rising may be prevented.

In addition, because the oil flow path between the lower end 630 of the second plate 600 and the lower surface 13 of the case 10 is not excessively and largely formed, the oil prior to the driving device 200 operating may block between the lower end 630 of the second plate 600 and the lower surface 13 of the case 10, and the refrigerant may be prevented from flowing therebetween even after the driving device 200 is operated. Accordingly, because sufficient pressure difference may be formed between the first to third areas 14, 15 and 16, oil may be fed stably from the third area 16 to the oil feed pipe 400.

The horizontal type rotary compressor 1 according to an example embodiment of the disclosure may further include a discharge pipe 40.

The discharge pipe 40 may be configured to penetrate the outlet 12 of the case and have one end 41 disposed in the third area 16 and formed to be bent to an upper side. Accordingly, even if the oil-level in the third area 16 increases, because the one end 41 of the discharge pipe 40 is positioned sufficiently high, the oil may not be leaked to the outside of the case 10 through the discharge pipe 40 unintentionally.

Figure 5:
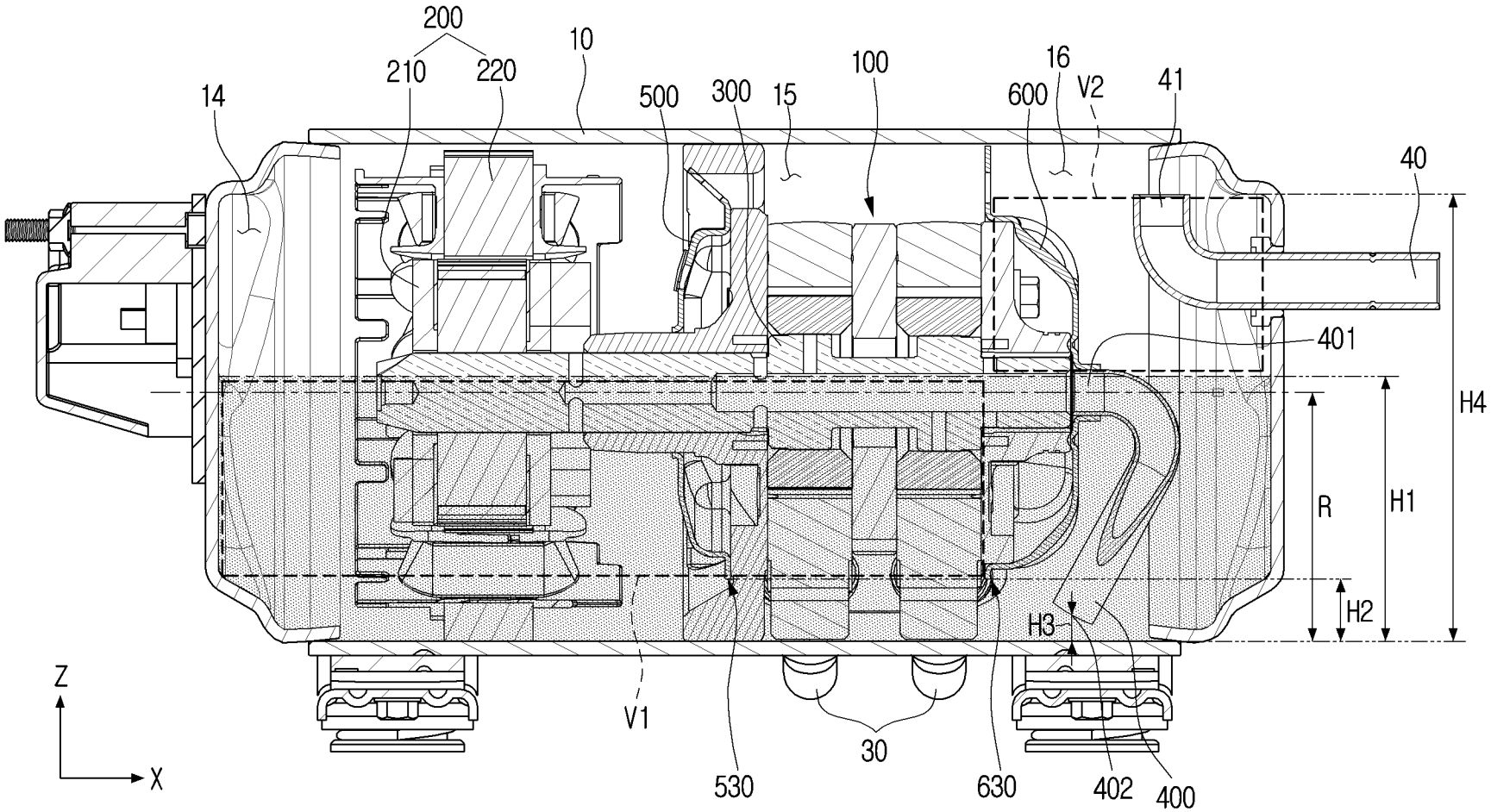
FIG. 5 is a cross-sectional view illustrating an oil-level of when a driving device is not in an operating state.
Figure 6:
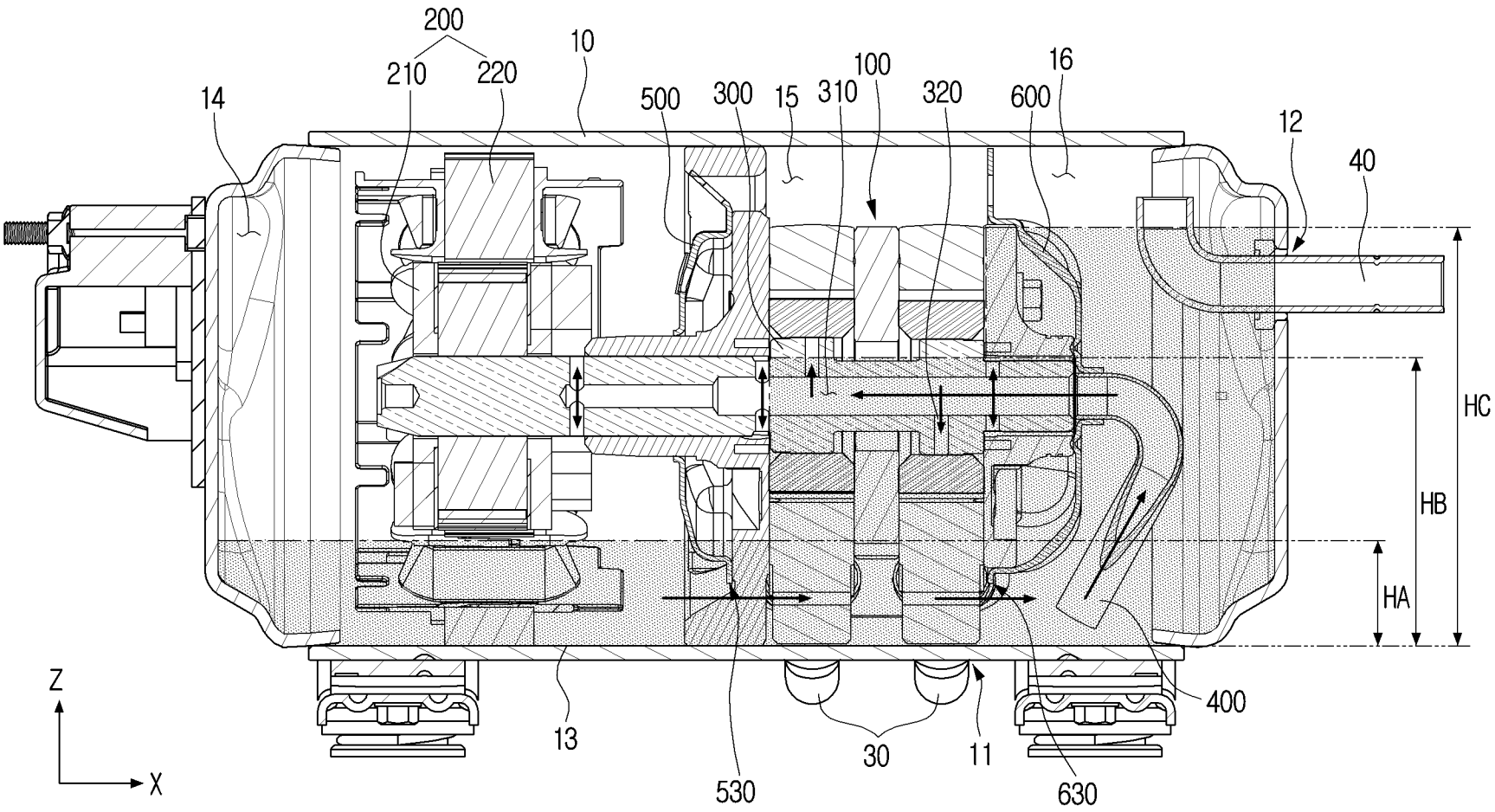
FIG. 6 is a cross-sectional view illustrating an oil-level of when a driving device is in an operating state.

FIG. 5 is a cross-sectional view illustrating an oil-level of when a driving device is not in an operating state. FIG. 6 is a cross-sectional view illustrating an oil-level of when a driving device is in an operating state.

Referring to FIG. 5 and FIG. 6, the oil accommodated in the case 10 may be stored to a first height H1 based on the driving device 200 not operating. That is, because no pressure differences occurred in the inside of the horizontal type rotary compressor 1 at the initial state, the oil stored in the first to third areas 14, 15 and 16 may all have an oil-level of the same first height H1.

The lower end 530 of the first plate 500 may be spaced apart from the lower surface 13 of the case 10 by a second height (H2) which is shorter than the first height H1. In addition, the lower end 630 of the second plate 600 may also be spaced apart from the lower surface 13 of the case 10 by the second height H2 which is shorter than the first height H1.

That is, the oil having a sufficiently high initial height may block between the lower ends 530 and 630 of the first and second plates 500 and 600 and prevent the refrigerant from flowing therebetween. Accordingly, because sufficient pressure difference may be formed between the first to third areas 14, 15 and 16, oil may be fed stably from the third area 16 to the oil feed pipe 400.

Based on the driving device 200 operating, the oil may flow from the first area 14 to the second area 15, and from the second area 15 to the third area 16 according to pressure difference being formed between the first to third areas 14, 15 and 16. Accordingly, the oil stored in the first area 14 may have an oil-level of a first supply height HA, the oil stored in the second area 15 may have an oil-level of a second supply height HB, and the oil stored in the third area 16 may have an oil-level of a third supply height HC. The second supply height HB may be longer than the first supply height HA, and the third supply height HC may be longer than the second supply height HB.

In addition, the other end 402 of the oil feed pipe 400 may be spaced apart from the lower surface 13 of the case 10 by a third height H3. The second height H2 between the lower ends 530 and 630 of the first and second plates 500 and 600 and the lower surface 13 of the case 10 may be longer than the third height H3, and shorter than a radius (R) of the case 10.

Accordingly, the oil with an initial oil-level higher than the second height H2 may easily flow to the other end 402 of the oil feed pipe 400. In addition, considering that oil is initially filled to a height of the radius R of the case 10 in general, because the oil blocks between the lower ends 530 and 630 of the first and second plates 500 and 600, the refrigerant may be prevented from flowing therebetween. Accordingly, because sufficient pressure difference may be formed between the first to third areas 14, 15 and 16, the oil may be fed stably from the third area 16 to the oil feed pipe 400.

A space disposed lower than the first height H1 and higher than the second height H2 from among the first and second areas 14 and 15 may have a first volume V1. A space disposed higher than the first height H1 and lower than the one end 41 of the discharge pipe 40 from among the third area 16 may have a second volume V2.

The second volume V2 may be greater than the first volume V1. Accordingly, even if the oil-level of the third area 16 is increased due to the driving device 200 operating and oil from the first and second areas 14 and 15 flowing to the third area 16 by the pressure difference, the oil may not be unintentionally leaked to the outside of the case 10 through the one end 41 of the discharge pipe 40.

Figure 7:
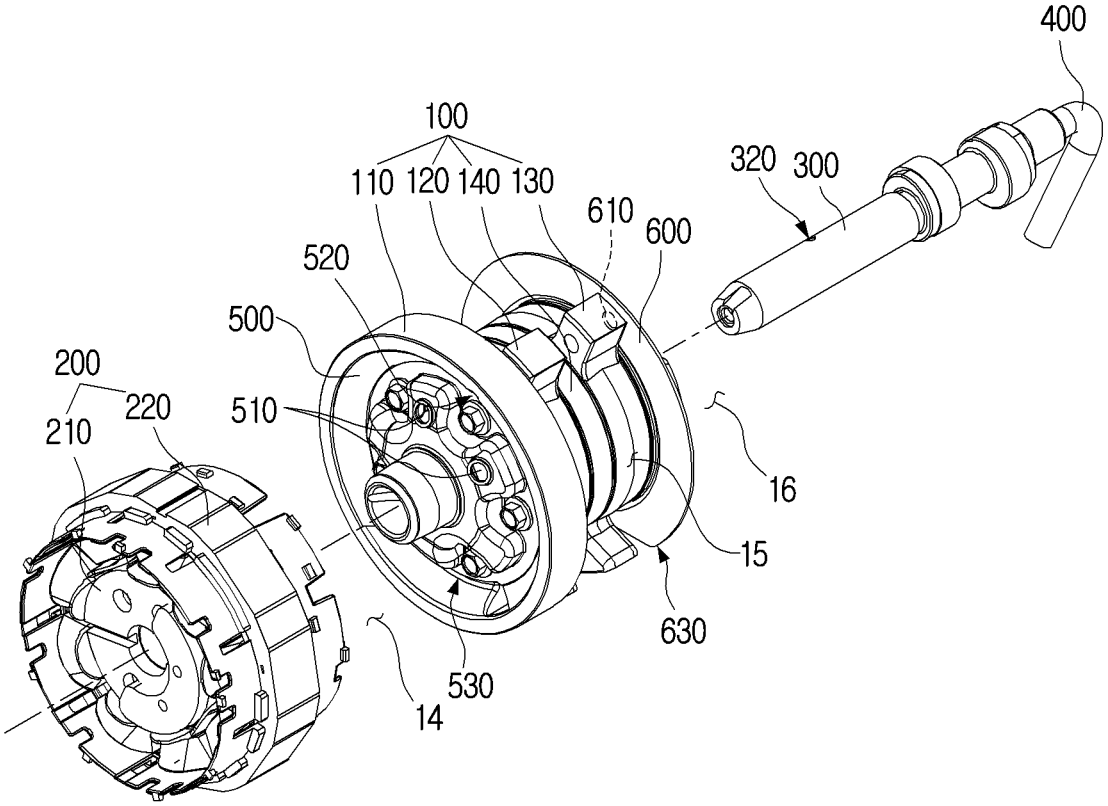
FIG. 7 is an exploded perspective view illustrating a horizontal type rotary compressor according to an embodiment.
Figure 8:
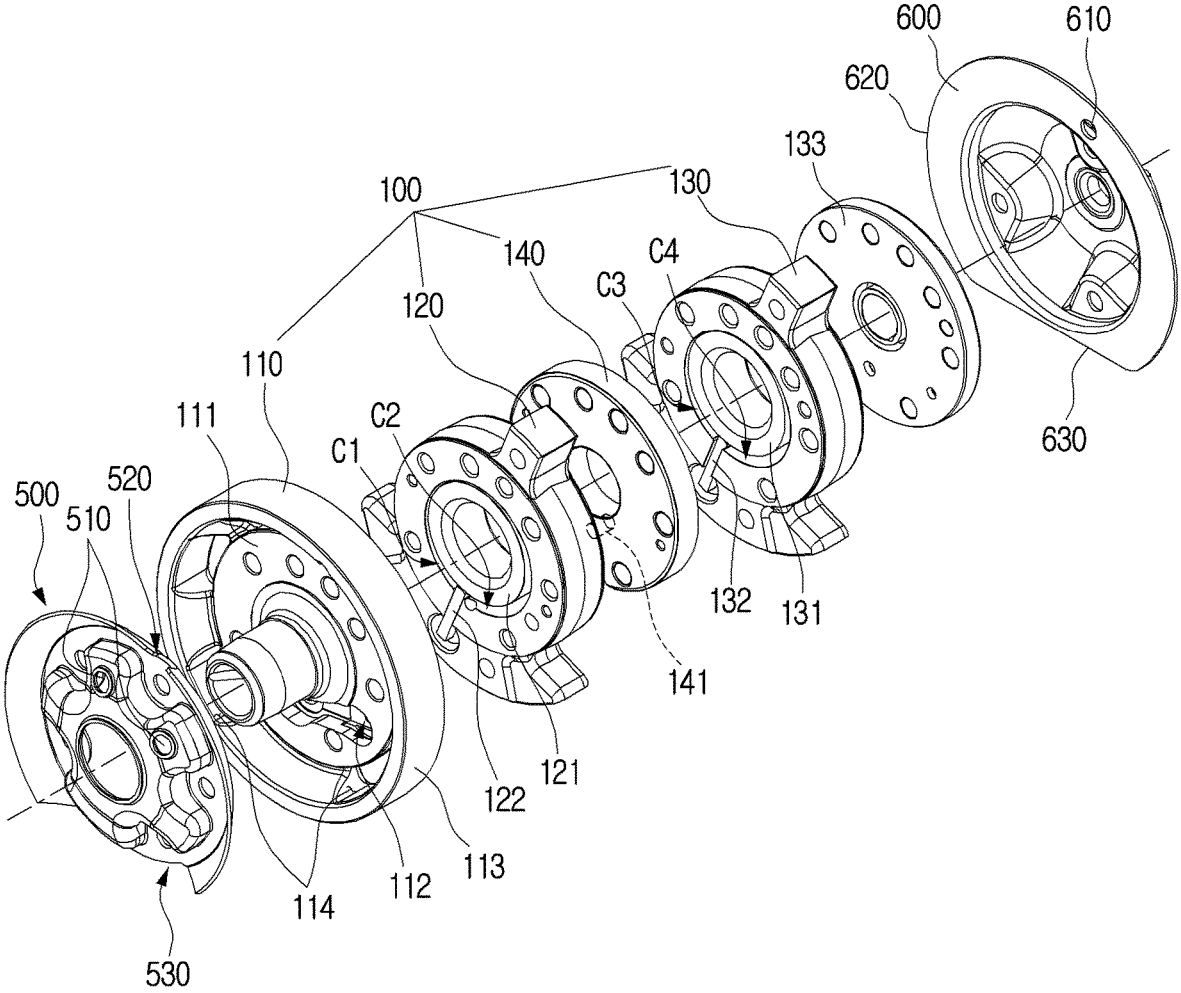
FIG. 8 is an exploded perspective view illustrating a compression device of FIG. 7.

FIG. 7 is an exploded perspective view illustrating a horizontal type rotary compressor according to an embodiment. FIG. 8 is an exploded perspective view illustrating a compression device of FIG. 7.

Referring to FIG. 7 and FIG. 8, the compression device may include a flange member 110. The flange member 110 may have one surface 111 facing the first area 14 and covered by the first plate 500, and include a third hole 112 communicating the compression space and the first area 14.

The flange member 110 may have the side surface 113 is in contact with the inner surface of the case 10, and include a fourth hole 114 which is formed at a lower side than the lower end 530 of the first plate 500.

Accordingly, the refrigerant compressed in the compression device 100 may be configured to flow to the first area 14 sequentially passing through the first area 14 of the flange member 110 and the discharge holes 510 of the first plate 500. In addition, the oil stored in the first area 14 may pass between the lower end 530 of the first plate 500 and the lower surface 13 of the case 10, then, pass the fourth hole 114 of the flange member 110, and move to the second area 15.

The compression device 100 may include a first cylinder 120, a second cylinder 130, and a middle plate 140.

The first cylinder 120 may include a rolling piston 121 configured to perform an orbiting motion with eccentricity in the compression space and a vane 122 configured to be in contact with the rolling piston 121 and divide the compression space into a suction chamber C1 and a compression chamber C2.

The second cylinder 130 may include a rolling piston 131 configured to perform an orbiting motion with eccentricity in the compression space and a vane 132 configured to be in contact with the rolling piston 131 and divide the compression space into a suction chamber C3 and a compression chamber C4. The compression space of the second cylinder 130 may be sealed by the middle plate 140 and an additional flange member 133.

Specifically, the rolling pistons 121 and 131 may be formed in a cylindrical shape, and an eccentric part coupled with the rotating shaft 300 may be disposed inside. As the eccentric part moves according to the rotating shaft 300 rotating, the rolling pistons 121 and 131 may be orbitally moved. The respective rolling pistons 121 and 131 of the first and second cylinders 120 and 130 may be eccentrically rotated to have a phase difference of 180 degrees in a circumferential direction of the rotating shaft 300.

That is, the compression device 100 may have a twin cylinder structure. However, the structure of the compression device 100 is not limited thereto, and may also have a single cylinder structure.

The middle plate 140 may be disposed between the first and second cylinders 120 and 130. The middle plate 140 may include a fifth hole 141 communicating compression chamber C2 of the first cylinder 120 and the compression chamber C4 of the second cylinder 130. The third hole 112 of the flange member 110 may be configured to communicate the compression chamber C2 of the first cylinder 120 and the first area 14.

Accordingly, the refrigerant compressed in the second cylinder 130 may sequentially penetrate the fifth hole 141 of the middle plate 140, the third hole 112 of the flange member 110, and the discharge holes 510 of the first plate 500 to flow to the first area 14.

While the disclosure has been illustrated and described with reference to various example embodiments thereof, it will be understood that the various example embodiments are intended to be illustrative, not limiting. It will be understood by those skilled in the art that various changes in form and details may be made therein without departing from the true spirit and full scope of the disclosure, including the appended claims and their equivalents.

What is claimed is:

1. A horizontal type rotary compressor, comprising:

a case configured to store oil, and including an inlet and an outlet;

a compressor having a compression space in which refrigerant introduced from the inlet is accommodated;

a driver disposed at a first side of the compressor and configured to drive the compressor;

a rotating shaft configured to penetrate the compressor and connect the driver and the compressor;

an oil feed pipe disposed at a second side of the compressor, and having a first end of the oil feed pipe connected to the rotating shaft and a second end of the oil feed pipe disposed adjacent with a lower surface of the case such that the second end of the oil feed pipe is submerged in oil;

a first plate configured to divide an inside of the case into a first area in which the driver is disposed, and a second area in which the compressor is disposed, the first plate including:

a discharge hole through which a compressed refrigerant is discharged from the compressor to the first area, and a first hole formed at an upper side of the first plate, through which the compressed refrigerant flows from the first area to the second area; and a second plate configured to divide the inside of the case into the second area and a third area in which the oil feed pipe is disposed and which communicates with the outlet, the second plate including:

a second hole formed at an upper side of the second plate, through which the compressed refrigerant flows from the second area to the third area, wherein a lower end of the first plate and a lower end of the second plate are spaced apart from the lower surface of the case to form an oil flow path along the lower surface of the case extending from the first area and under the first plate to the second area, and extending from the second area and under the second plate to the third area.

2. The horizontal type rotary compressor of claim 1, wherein the rotating shaft comprises:

an oil flow path space configured to communicate with the oil feed pipe and formed in a lengthwise direction inside of the rotating shaft and an oil feed hole configured to communicate the oil flow path space and an outside of the rotating shaft.

3. The horizontal type rotary compressor of claim 1, wherein a diameter of the second hole is between 0.04 fold or more and 0.1 fold or less of an inner diameter of the case.

4. The horizontal type rotary compressor of claim 1, wherein the oil accommodated in the case is stored at a first height based on the driver not operating, and wherein the lower end of the first plate and the lower end of the second plate are configured to be spaced apart from the lower surface of the case by a second height which is shorter than the first height.

5. The horizontal type rotary compressor of claim 4, wherein the second side of the oil feed pipe is configured to be spaced apart from the lower surface of the case by a third height, and wherein the second height is longer than the third height, and shorter than a radius of the case.

6. The horizontal type rotary compressor of claim 4, further comprising:

a discharge pipe configured to penetrate the outlet and have a first end of the discharge pipe disposed in the third area;

wherein a first space disposed lower than the first height and higher than the second height from the first area and second area has a first volume, wherein a second space disposed higher than the first height and disposed lower than an end of the outlet from the third area has a second volume, and wherein the second volume is greater than the first volume.

7. The horizontal type rotary compressor of claim 1, further comprising:

a discharge pipe configured to penetrate the outlet and have an end of the discharge pipe disposed in the third area and formed to be bent to an upper side of the casing.

8. The horizontal type rotary compressor of claim 1, wherein the driver comprises:

a rotor configured to be disposed surrounding the rotating shaft and rotatable with the rotating shaft and a stator configured to be fixed at an inner surface of the case and support the rotor to be rotatable.

9. The horizontal type rotary compressor of claim 1, wherein the second plate has a side surface contacting with an inner surface of the case.

10. The horizontal type rotary compressor of claim 1, wherein the inlet communicates with an outside of the case and the second area.

11. The horizontal type rotary compressor of claim 1, wherein the compressor comprises a flange member which has one surface facing the first area and covered by the first plate, and which comprises a third hole communicating the compression space and the first area.

12. The horizontal type rotary compressor of claim 11, wherein the flange member has a side surface contacting with an inner surface of the case, and comprises a fourth hole formed lower than the lower end of the first plate.

13. The horizontal type rotary compressor of claim 11, wherein the compressor comprises:

a first cylinder and a second cylinder which respectively comprise a rolling piston configured to perform an orbiting motion with eccentricity in the compression space and a vane configured to be in contact with the rolling piston and divide the compression space into a suction chamber and a compression chamber; and a middle plate configured to be disposed between the first cylinder and the second cylinder, the middle plate comprising a fifth hole communicating the compression chamber of the first cylinder and the compression chamber of the second cylinder, wherein the third hole is configured to communicate the compression chamber of the first cylinder and the first area.

14. The horizontal type rotary compressor of claim 1, wherein a cross-section area between the lower end of the second plate and the lower surface of the case is between 0.05 fold or more and 0.35 fold or less of a cross-section area of the case.

15. A home appliance configured to adjust temperature through heat exchange with an outside using a refrigerant, the home appliance comprising:

a horizontal type rotary compressor configured to compress the refrigerant, wherein the horizontal type rotary compressor includes:

a case configured to store oil, and including an inlet and an outlet, a compression device configured to compress refrigerant introduced from the inlet, a driver disposed at a first side of the compression device and configured to drive the compression device, a first plate configured to divide an inside of the case into a first area in which the driver is disposed, and a second area in which the compression device is disposed, the first plate including:

a discharge hole through which compressed refrigerant is discharged from the compression device to the first area, and a first hole formed at an upper side of the first plate, through which the compressed refrigerant flows from the first area to the second area, and a second plate dividing to divide the inside of the case into the second area and a third area which communicates with the outlet, and the second plate including:

a second hole formed at an upper side of the second plate, through which the compressed refrigerant flows from the second area to the third area, wherein a lower end of the first plate and a lower end of the second plate are spaced apart from the lower surface of the case to form an oil flow path along the lower surface of the case extending from the first area and under the first plate to the second area, and extending from the second area and under the second plate to the third area.

* * * * *